US008487507B1

(12) United States Patent
Cabauy et al.

(10) Patent No.: US 8,487,507 B1
(45) Date of Patent: Jul. 16, 2013

(54) TRITIUM DIRECT CONVERSION SEMICONDUCTOR DEVICE

(76) Inventors: Peter Cabauy, Miami, FL (US); Larry C. Olsen, Kennewick, WA (US); Noren Pan, Wilmette, IL (US)

( * ) Notice: Subject to any disclaimer, the term of this patent is extended or adjusted under 35 U.S.C. 154(b) by 386 days.

(21) Appl. No.: 12/637,735

(22) Filed: Dec. 14, 2009

Related U.S. Application Data

(60) Provisional application No. 61/122,401, filed on Dec. 14, 2008.

(51) Int. Cl.
*G21H 1/06* (2006.01)

(52) U.S. Cl.
USPC ..... 310/303; 310/301

(58) Field of Classification Search
USPC ..... 310/301–305; 257/428–429, 430, 257/434; 136/202
See application file for complete search history.

(56) References Cited

U.S. PATENT DOCUMENTS

| | | | | |
|---|---|---|---|---|
| 2,745,973 | A * | 5/1956 | Rappaport | 310/303 |
| 2,976,433 | A * | 3/1961 | Rappaport et al. | 310/303 |
| 2,998,550 | A * | 8/1961 | Collins et al. | 257/429 |
| 3,278,811 | A * | 10/1966 | Mori | 136/244 |
| 3,714,474 | A * | 1/1973 | Hoff, Jr. | 310/303 |
| 4,158,286 | A * | 6/1979 | Reinberg | 331/3 |
| 4,275,405 | A * | 6/1981 | Shannon | 257/252 |
| 5,642,014 | A * | 6/1997 | Hillenius | 310/303 |
| 5,859,484 | A * | 1/1999 | Mannik et al. | 310/303 |
| 6,118,204 | A * | 9/2000 | Brown | 310/303 |
| 6,238,812 | B1 * | 5/2001 | Brown et al. | 429/5 |
| 6,281,426 | B1 * | 8/2001 | Olson et al. | 136/249 |
| 6,479,919 | B1 * | 11/2002 | Aselage et al. | 310/303 |
| 6,949,865 | B2 | 9/2005 | Gadeken | |
| 7,250,323 | B2 | 7/2007 | Gadeken | |
| 7,301,254 | B1 * | 11/2007 | Lal et al. | 310/309 |
| 8,134,216 | B2 * | 3/2012 | Spencer et al. | 257/428 |
| 2004/0154656 | A1 | 8/2004 | Weaver | |
| 2007/0080605 | A1 | 4/2007 | Chandrashekhar | |
| 2012/0133244 | A1 * | 5/2012 | Spencer et al. | 310/303 |

OTHER PUBLICATIONS

V.M.Andreev et al. "Tritium-powered betacells based on AIxGA1-xAs" IEEE p. 1253-1256, 2000.*

F.K.Manase et al. "Schottky Barrier Betavoltaic Battery" IEEE Transactions on Nuclear Science, vol. NS-23, No. 1, pp. 860-870, Feb. 1976.*

T. Kosteski et al. "Tritiated amorphous silicon betavoltaic devices", IEE Proceedings on Circuits, Devices & Systems, vol. 150, No. 4, pp. 274-281, Aug. 2003.*

C. Hosberg et al. "GaN Betavoltaic Energy Converters" 31st IEEE Photovoltaics Specialist Conference, Jan. 2005.*

Bower, Barbanel, Shreter, Bohnert; Reference book entitled Polymers, Phosphors, Voltaics Radioisotope Microbatteries, Published by CRC Press, LLC, 2000 Corporate Boulevard NW, Boca Raton, FL 33431, USA; Copyright 2002, pp. 15-27.

* cited by examiner

*Primary Examiner* — Burton Mullins
(74) *Attorney, Agent, or Firm* — John L. DeAngelis; Beusse Wolter Sanks Mora & Maire, P.A.

(57) ABSTRACT

A multilayer device for producing electricity. The device comprising a betavoltaic source layer for generating beta particles, and at least three semiconductor layers each having a bandgap substantially similar to a band gap of the other layers, the at least three layers comprising a doped top layer, an undoped intermediate layer and a doped bottom layer, wherein the top and the bottom layers are doped with opposite-type dopants, and wherein the top layer is closer to the betavoltaic source layer than the bottom layer.

12 Claims, 6 Drawing Sheets

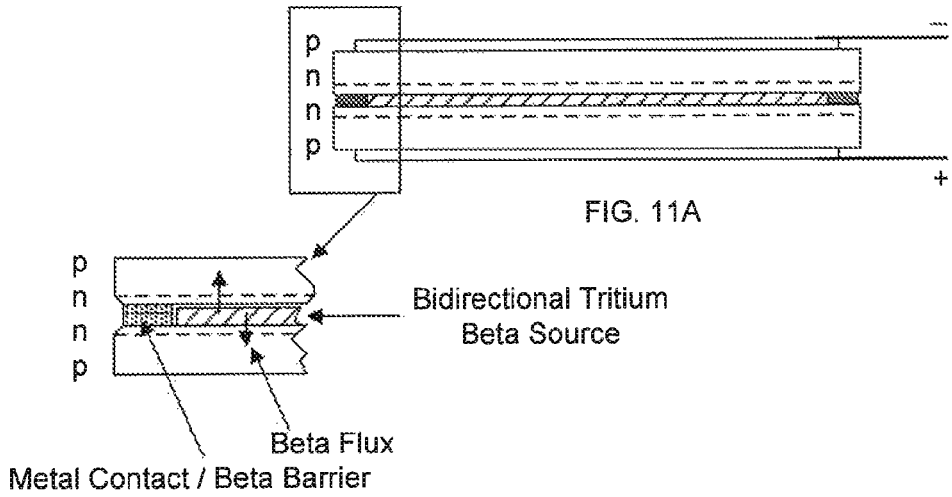
FIG. 11A
FIG. 11B
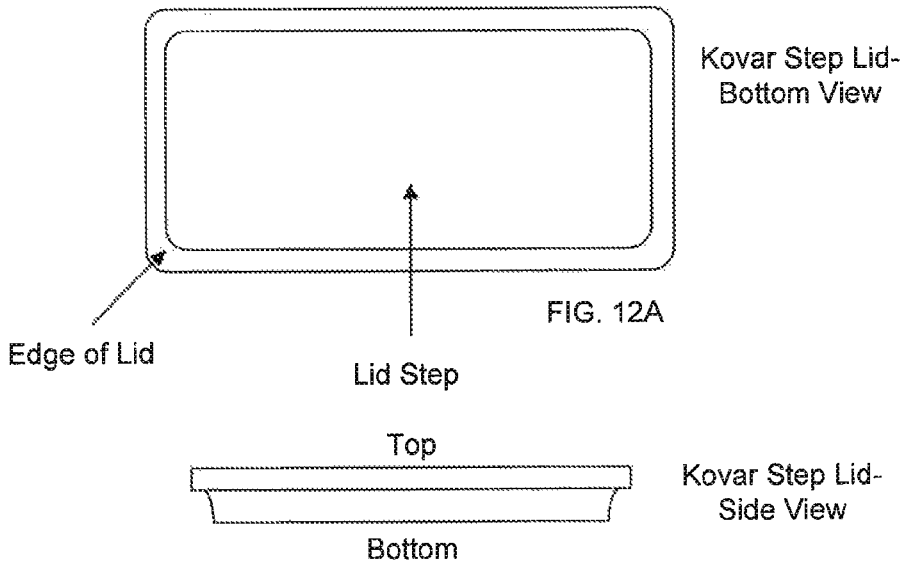
FIG. 12A
FIG. 12B

TRITIUM DIRECT CONVERSION SEMICONDUCTOR DEVICE

RELATED PATENT APPLICATIONS

The present application claims the benefit, under 35 U.S.C. 119(e), of the provisional patent application filed on Dec. 14, 2008 and assigned application No. 61/122,401.

BACKGROUND OF THE INVENTION

The direct conversion of radioisotope beta (electron) emissions into usable electrical power via beta emissions directly impinging on a semiconductor was first proposed in the 1950's. These devices are known as Direct Conversion Semiconductor Devices, Beta Cells, Betavoltaic Devices, Betavoltaic Batteries, Isotope Batteries etc. These direct conversion devices promise to deliver consistent long-term battery power for years and even decades. For this reason, many attempts have been made to commercialize such a device. However, in the hopes of achieving reasonable power levels, the radioisotope of choice often emitted unsafe amounts of high energy radiation that would either destroy the semiconductor within the betavoltaic battery or the surrounding electronic devices powered by the battery. The radiated energy may also be harmful to operators in the vicinity of the battery.

As a result of these disadvantages and in an effort to gain approval from nuclear regulatory agencies for these types of batteries, the choice for radioisotopes has been limited to low energy beta (electron) emitting radioisotopes such as Nickel-63, Promethium-147 or Tritium. Due to the fact, that Promethium-147 is regulated more stringently and requires considerable shielding and Nickel-63 has a low beta flux, Tritium has emerged as a leading candidate for such a battery device.

Tritium betavoltaic batteries, sometimes referred to as Tritium betavoltaic devices or Tritium direct conversion devices, have been promoted during the last thirty years. Tritium is a relatively benign radioisotope with low beta energy emission that can easily be shielded with as little as a thin sheet of paper. Tritium has a long track record in commercial use in illumination devices such as EXIT signs in commercial aircraft, stores, school buildings and theatres. It is also widely used in gun sights and watch dials, making it an ideal power source for the direct conversion devices. Unfortunately, Tritium's beta emissions are so low energy that it is has been difficult to efficiently convert it into usable electrical power for even the most low power applications, such as powering SRAM memory to prevent the loss of stored data.

Several attempts have been made to produce useful current from a Tritium betavoltaic battery. For example, polycrystalline or amorphous semiconductor based betavoltaic batteries are less expensive to manufacture and have been studied as possible Tritium batteries due to the fact that large surface areas may be produced in a thin-film-like fashion with embedded Tritium within the semiconductor or on the surface of the semiconductor. However, this approach is extremely inefficient (much less than 1%) with respect to the beta energy emissions entering the semiconductor. The main reason for this low semiconductor conversion efficiency is the high dark current or leakage current of the semiconductor that acts as a negative current. This high dark current competes with the battery current produced by the electron hole pairs (EHPs) created via the Tritium beta particles impinging on the semiconductor. In short, the polycrystalline and amorphous semiconductors have a high number of defects resulting in recombination centers for the EHPs created by the Tritium beta particles in the semiconductor and therefore resulting a very poor efficiency.

Other recent attempts have involved single crystalline semiconductor devices with a Tritium source such as a Tritiated polymer, aerogel or Tritiated metal hydride placed in direct contact with the semiconductor. Single crystalline semiconductors have longer carrier lifetimes and fewer defects resulting in a lower dark current. To date, the highest reported efficiencies for Tritium betavoltaic battery were published in a reference text entitled: "Polymers, Phosphors and Voltaics for Radioisotope Microbatteries" edited by K. Bower et al. The direct conversion single crystal semiconductors were exposed to a Tritium Metal Hydride source atop the semiconductor. The following homojunction semiconductor cells were utilized with the following results:

Silicon Cells:
Short Circuit Current=18.1 nA/cm^2
Open Circuit Voltage=0.162
Fill Factor=0.513
Tritiated Titanium Source=0.23 microwatts/cm^2
Efficiency=1.3%
Aluminum Gallium Arsenide (AlGaAs) Cells:
Short Circuit Current=58 nA/cm^2
Open Circuit Voltage=0.62
Fill Factor=0.751,
Power=27 nW/cm^2
Tritiated Titanium Source=0.48 microwatts/cm^2,
Efficiency=5.6%

Silicon cells are a preferred choice due to their low cost. However, their low efficiency makes them a poor choice for even the most low power applications, such as SRAM memory devices. The performance of the AlGaAs homojunction cell is attractive with one of the highest reported efficiencies and would be suitable for powering an SRAM memory device through the stacking of Tritiated metal hydride layers and AlGaAs homojunction cells. However, AlGaAs homojunctions cells are difficult to reproduce consistently with uniform dark currents across a semiconductor device due to the oxidation of the aluminum. AlGaAs is also an expensive option to scale up. In addition, the materials production technology is not well developed.

The main disadvantage with the above listed approaches for betavoltaic devices is the construction of the semiconductor with the same design structure as a solar cell structure. Hence the betavoltaic device suffers in efficiency, especially when a weak beta emitter such as Tritium is utilized. Moreover, the need for a high efficiency single crystalline semiconductor with a uniform low dark current across a whole production wafer is key to allowing the Tritium betavoltaic battery to be affordably commercialized.

Safety concerns over containment of the Tritium based battery have emerged as another obstacle to commercialization of the Tritium battery. In commercially available products such as Tritium illumination products (e.g. EXIT signs, gun sights and watch dials) the Tritium is in gaseous form and contained within a glass vial. Many accidents involving Tritium release due to the breakage of the Tritium vials in EXIT signs have caused public concerns and resulted in costly clean ups.

In the case of a Tritium battery with a solid Tritium metal hydride, the risk to exposure is much less than in gaseous form. However, the Tritium metal hydride still involves a miniscule amount of Tritium release when open to the environment at room temperature. Although several Tritium based batteries have been proposed including direct conversion devices built within an integrated circuit, a method of effectively hermetically packaging the battery containing the Tritium metal hydride has yet to be proposed.

A major obstacle to hermetically sealing this type of battery is the risk associated with using a sealing process that involves high temperatures, i.e., above 200-300° C., where Tritium is released from the metal hydride causing failure of the battery after sealing or worse, causing Tritium exposure at the manufacturing facility and to the operator of the equipment for sealing the battery.

In addition to the above listed obstacles, the texturing of a direct conversion semiconductor device to increase the surface area exposed to radiation emission has been proposed several times in the past. For example, on page 282 of the book titled "Polymers, Phosphors and Voltaics for Radioisotope Microbatteries" edited by K. Bower et al., the use of porous Silicon and Tritium inserted into porous silicon holes was proposed as a means of increasing the surface area of the semiconductor device by 20 to 50 times, in contrast to the original planar semiconductor surface area.

The following published patent applications and patents each propose a method of increasing the surface area of the semiconductor by textured growth of the semiconductor or a post-growth texturing method:

US Patent Application Publication 2004/0154656

US Patent Application Publication 2007/0080605

U.S. Pat. No. 7,250,323

U.S. Pat. No. 6,949,865

Central to this approach is the hope that an increase in surface area exposed to radioisotope emissions will increase the power per unit volume of the direct conversion semiconductor device. The overall goal of this approach is to not only reduce the size of the direct conversion device but also to potentially reduce the cost associated with producing the equivalent surface area in a planar semiconductor device.

The problem with such an approach arises when a relatively low energy radioisotope such as Tritium is used. In this case, the incident power is quite small per unit area exposed and the dark current of the semiconductor device is a significant factor in the overall efficiency of the device. For this reason, it is preferred to use single crystal semiconductors where device defects are minimized and the dark current is sufficiently low to produce electrical power.

Unfortunately, alterations to the semiconductor surface, as proposed above, risk increasing lattice defects, resulting in a high number of recombination centers for electron hole pairs (EHP's). This creates a direct conversion semiconductor device with a low open circuit voltage and short circuit current resulting in a low overall efficiency.

BRIEF DESCRIPTION OF THE DRAWINGS

The present invention can be more easily understood and the advantages and uses thereof more readily apparent when the detailed description of the present invention is read in conjunction with the figures wherein:

FIGS. 11A and 11B illustrate a parallel connection of two n/p (or p/n) cells.

FIGS. 12A and 12B illustrate a seal lid for use with the device of the present invention.

In accordance with common practice, the various described features are not drawn to scale, but are drawn to emphasize specific features relevant to the invention. Like reference characters denote like elements throughout the figures and text.

DETAILED DESCRIPTION OF THE INVENTION

Before describing in detail the particular methods and apparatuses related to tritium direct conversion semiconductor devices, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the invention. The following embodiments are not intended to define limits as to the structure or method of the invention, but only to provide exemplary constructions. The embodiments are permissive rather than mandatory and illustrative rather than exhaustive.

The present invention relates to a Tritium Direct Conversion Semiconductor Device comprised of a single crystal semiconductor and a device structure with both a low dark current and high efficiency for Tritium conversion. It should be understood that the high efficiency and long term life (e.g. over 10 years) of the various device structure embodiments are suitable for use with other candidate radioisotopes for betavoltaic operations (e.g., Promethium-147 and Nickel-63).

Figure 1:
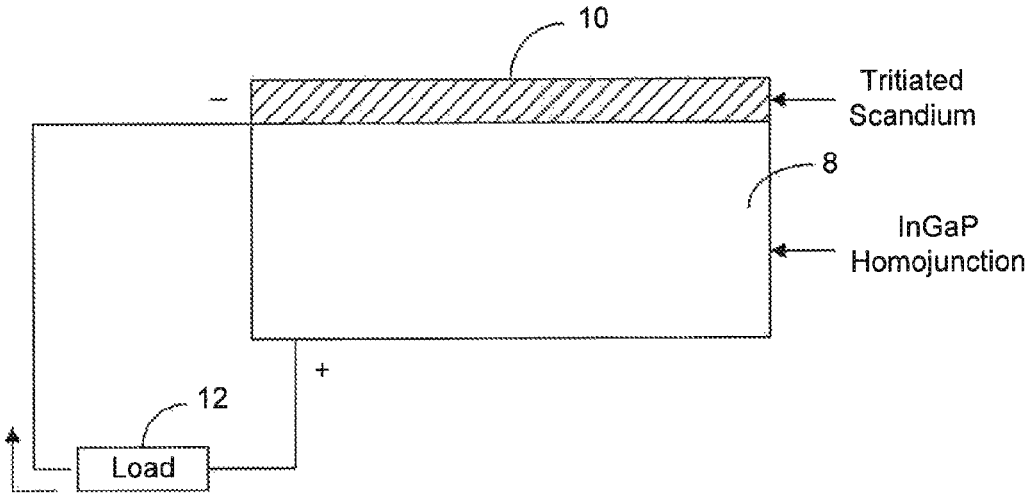
FIG. 1 is a representation of an InGaP homojunction in contact with a tritiated scandium source connected to a load.

One embodiment of the present invention proposes a novel use of Indium Gallium Phosphide homojunction semiconductor 8 in conjunction with a Tritiated metal hydride source 10, as illustrated in FIG. 1, for supplying power to a load 12. The Tritiated metal hydride source (e.g, Scandium Tritide (Tritiated Scandium), Titanium Tritide etc.) is directly in contact with the semiconductor to generate electrical power at an efficiency of 7.5% or higher with respect to the beta electrons impinging on the Indium Gallium Phosphide homojunction. InGaP is one of the larger band gap materials and has never been used in a Tritium based Direct Conversion Battery.

One embodiment uses a compositions of the Indium Gallium Phosphide homojunction comprising $In_{0.49}$ $Ga_{0.51}$ P (subsequently referred to as InGaP). The band gap of this semiconductor is 1.9 eV and the materials production technology is well developed by the solar cell industry. The technology also lends itself to high quality growth with few lattice defects and low dark current characteristics. In addition, InGaP may be mass produced with a high yield due to its manufacturing process maturity over other type III-V semiconductors, such as AlGaAs, thus lowering the cost of Tritium betavoltaic batteries based on InGaP. InGaP device structures are grown by metal-organic-vapor-deposition (MOCVD) as is known by those skilled in the art.

Figure 2:
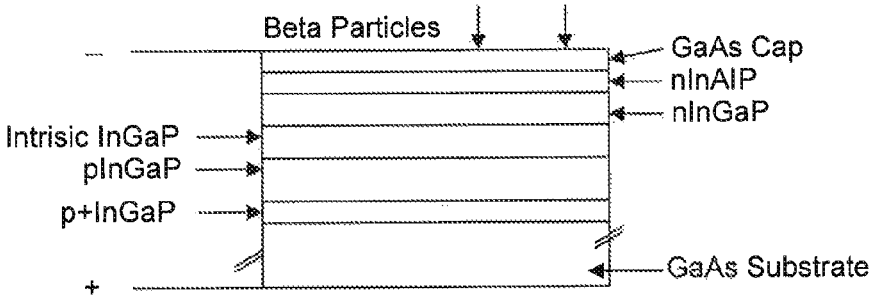
FIG. 2 illustrates a physical structure of an InGaP homojunction device for tritium betavoltaic conversion.
Figure 3:
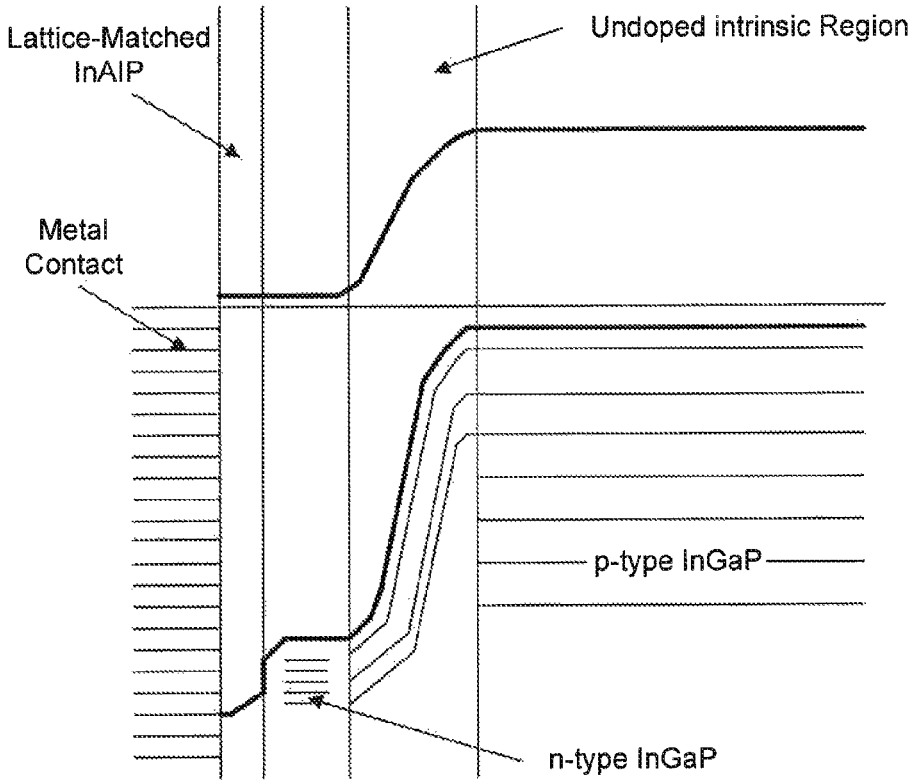
FIG. 3 is an electron band diagram for the InGaP device of FIG. 2.

The description of this embodiment presents novel and non obvious features that allow efficient conversion of tritium beta flux to electrical power. FIGS. 2 and 3 illustrate the physical structure and electron band diagram, respectively. Each layer has the same lattice constant as GaAs substrate so that the number of dislocations generated by growth of the individual layers is minimized. The beta particles represented by arrowheads in FIG. 2 are released by the Tritiated Scandium material of FIG. 1.

FIG. 2 illustrates the individual layers of the homojunction semiconductor 8, comprising, from the bottom:

- a GaAs substrate
- a p+InGaP layer (a back surface field or reflector or anti-window)
- a pInGaP layer (base)
- an intrinsic InGaP layer (for preventing diffusion between the p-doped and n-doped layers)
- an nInGaP layer (emitter)
- an nInAlP layer (window layer that allows electrons to pass but blocks holes with a closely matched lattice structure to one or both layers it is contact with)
- a GaAs cap layer (may be highly doped)

In another embodiment the GaAs substrate is replaced by a Germanium substrate.

There are several features of this structure that allow efficient betavoltaic energy conversion:

(a) High quality, large band gap semiconductor junction resulting in a highly efficient device;

(b) Back-surface field created by highly doped the $p^+$InGaP layer (can also be created by p-type InAlP or InAlGaP);

(c) A lattice-matched n-type InAlP window layer to reflect holes in the emitter leading to a low dark current;

(d) A GaAs Cap layer of about a few hundred angstroms or less;

(e) and a 1000 to 3000 Å layer of intrinsic InGaP to act as a buffer to dopant zinc diffusion into the n-type emitter region.

The features (a), (b) and (c) may be important for solar cell operation but their utilization in Tritium betavoltaic application is considered novel in the present embodiment. The novel features (d) and (e) may be important for betavoltaic conversion, but are not necessarily used for photovoltaic conversion. Both of these features allow the achievement of low dark currents preferred for betavoltaic operation. The novel lattice-matched InAlP window layer prevents the formation of dislocations at the InAlP-InGaP interface, which would increase the dark current. The GaAs Cap layer keeps the InAlP layer from oxidizing, the absence of which would introduce defects for EHP recombination at the InAlP-InGaP region. This cap layer, therefore augments hole reflection at that interface. The GaAs Cap layer does not absorb a significant percentage of the beta flux, and therefore can be tolerated.

In solar cell operation the GaAs cap layer is typically removed except under the metal gridline contacts. This is required since a cap layer across regions between the metal gridline contacts would significantly reduce the efficiency of the solar cell by absorbing too many of the high energy photons. For this reason, the GaAs Cap layer is normally etched away completely in a solar cell, except for the regions under the gridline metal contacts. Since in solar cell operation the remaining GaAs Cap layer under the metal gridline contacts is a conduit for the electrons to the grid metal lines, the GaAs Cap layer is normally doped to a level of 10^19 ND/cm^3 in order to create good conduction for milliamps or higher current levels required in photovoltaic operations.

This high doping may unfortunately create defects in the n-type InAlP layer for betavoltaic operations. In other words, the dark current and voltage can be reduced due to the high doping of this layer. This is not important for photovoltaic operations since the dark current is so low compared to the milliamps current levels generated in a solar cell photovoltaic operation, but it is extremely important for the betavoltaic operation where the current levels are in the range of nanoamps. For this reason, the novel application of a reduced dopant layer may be introduced. The betavoltaic GaAs cap layer doping may be reduced to a level of 10^18 ND/cm^3 reducing the number defects that are caused by diffusion of the GaAs Cap layer dopant into the n-type InAlP layer.

The novel intrinsic InGaP layer is not used in photovoltaic operation but may be important for betavoltaic operation due to the fact that it can achieve low dark currents. All layers of the InGaP device structure are grown at high temperatures (e.g. 500° C.-700° C.). In particular, the intrinsic layer, the n-InGaP emitter layer, the n-InAlP layer and the n-GaAs Cap layer are all grown at high temperatures. During the time required for growth of these layers, the p-type dopant zinc in the p-InGaP layer will diffuse toward the n-type films. If the intrinsic layer is too thin and allows zinc to diffuse into the emitter layer and the InAlP region, the dark current will increase and the betavoltaic device performance is degraded. Thus, since low dark currents are critical for Tritium betavoltaic energy conversion, the intrinsic layer must be thick enough to be an effective buffer to zinc diffusion. An intrinsic layer of approximately 1000-3000 Angstroms or more is sufficient to produce a low dark current betavoltaic device.

Although the present invention utilizes an intrinsic layer of InGaP that is 1000-3000 Å, it is also possible in one embodiment of the invention to remove the intrinsic layer or to use a substantially smaller thickness of about e.g., 50-100 Å.

In another embodiment of the invention the GaAs cap layer may be also be removed from the structure.

Note that without the intrinsic layer, the uniformity of the low dark current across a wafer is decreased significantly to yields of 30-40% or less per wafer. This is due to a higher number of resulting defects per wafer processing run. However, with the intrinsic layer in place, the low dark current yield is approximately 80-100% of the wafer. This results in a significant cost reduction in the processing of betavoltaic devices. Furthermore, the intrinsic layer lowers the dark current and produces a higher open circuit voltage for the InGaP betavoltaic device of about 0.1 volts as opposed to an InGaP betavoltaic device without the intrinsic layer. This has helped increase the efficiency of the InGaP betavoltaic device.

It should be noted that the Tritium InGaP betavoltaic structure presents novel and non-obvious features that provide a low dark current and a high voltage and collection efficiency. The following data was obtained with solid Tritiated metal hydride sources (e.g. Titanium Tritide, Scandium Tritide etc.) and have the highest reported efficiency of 7.5% with respect to the incident beta radiation impinging on the InGaP homojunction. In particular, for a Tritiated Scandium source with a 250 to 500 nanometer thick Scandium film and an InGaP homojunction as shown in FIG. 2 the following results were achieved:

InGaP:
Short Circuit Current=45.2 nA/cm^2
Open Circuit Voltage=0.77
Fill Factor=0.79,
Power=27.5 nW/cm^2
Tritiated Scandium Source=0.369 microwatts/cm^2,
Efficiency=7.5%

In general the present invention demonstrates that the intrinsic layer in Tritium betavoltaic devices serves three important purposes: (a) it acts as a buffer to diffusion of dopant atoms from the base region into the emitter region; (b) it allows efficient collection of electron-hole pairs produced as a result of beta particle absorption; and (c) as a consequence, the base region can be heavily doped so that the built-in voltage can be maximized. The high dopant density in the base region (with reference to FIG. 2, the pInGaP layer) is novel to the betavoltaic structure. This is due to the fact that it is not necessary to have a finite diffusion length in the base region for efficient carrier collection; hence a relatively high dopant density can be used in the base region to maximize the built-in potential. Minimizing diffusion of dopant atoms from the base to the emitter and window layers is desirable for achieving a low dark current. With EHP's mainly being produced in the high field region, a large collection efficiency can be achieved.

Tritium beta particle penetration in semiconductors is less than about one micron. Thus, it is clear that the emitter and window layers need to be very thin, preferably on the order of a few hundred Å so that most of beta particle absorption occurs in the high field region in the depletion layer (with respect to FIG. 2, the intrinsic InGaP layer or in another embodiment a material region between a p-doped and an n-doped region). Homojunctions are typically formed by abruptly reducing one dopant (e.g., for n-type material) and immediately introducing the other dopant (e.g., for p-type material). The intrinsic regions formed in devices discussed herein are created by reducing one dopant input to zero followed by film growth with neither donors nor acceptors introduced to form the intrinsic layer, and then initiating introduction of the other dopant. Unless noted otherwise, all of the device structures considered herein have an intrinsic layer between the emitter (e.g., the nInGaP layer) and base region (the pInGaP layer). The thickness of the intrinsic layer is selected so that most of the beta particle absorption occurs in the intrinsic layer. Thus, the intrinsic layers for Tritium betavoltaic devices is typically several thousand Angstroms thick.

The basic approach to solar cell fabrication does not typically include the intentional formation of a relatively wide intrinsic layer. However, since the Tritium betas are absorbed in a few thousand Angstroms, there is great flexibility regarding an increased doping density in the base.

In addition to the InGaP PIN structure already presented, the present invention can be applied to other PIN (p-doped layer—intrinsic layer—n-doped layer) homojunctions. Table 1 lists several exemplary PIN betavoltaic structures. Only structures for p-type base regions are listed in Table 1, but it should be noted that the base region may be switched to an n-type base and corresponding p-type emitter, a p-type lattice-matched window layer, and a p-type cap layer.

TABLE 1

Examples of PIN Structures with Lattice Matched Window Layers for Tritium Betavoltaics

| Eg of Base/Emitter | Base Region | Intrinsic Layer | Emitter Region | Window Layer | Cap Layer |
|---|---|---|---|---|---|
| 1.9 eV | p-InGaP | i-InGaP | n-InGaP | n-InAlP | n-GaAs |
| 2.3 eV | p-InAlP | i-InAlP | n-InAlP | n-ZnSe | n-GaAs |
| 1.45 | p-GaAs | i-GaAs | n-GaAs | n-InGaP | n-GaAs |
| 2.25 | p-GaP | i-GaP | n-GaP | n-AlP | n-GaP |
| 2.25 | p-GaP | i-GaP | n-GaP | n-ZnS | n-GaAs |
| 1.12 | p-Si | i-Si | n-Si | n-GaP | — |
| 1.12 | p-Si | i-Si | n-Si | n-ZnS | n-GaP |

As shown in Table 1, the lattice-matched window layer is critical for high efficiency Tritium betavoltaic devices. Since it is desirable to achieve as large a voltage as possible under the Tritium beta flux the dark current must be as low as possible. As noted for the specific case of InGaP PIN devices, the lattice matched window layer prevents the formation of dislocations in the window layer, which could cause formation of recombination centers at the interface of the window layer and emitter, and increase the dark current.

The cap layer referred to in Table 1 has two main functions. For the cases involving Al-containing window layers, the cap layer of GaAs prevents oxidation that would cause degradation of the current voltage characteristics. The cap layer is also characterized by reasonably low sheet resistance that allows effective current collection from the emitter. Since the current levels produced by the Tritium betavoltaic batteries are relatively low, the sheet resistance of the GaAs cap layer can be greater than 100 ohms/□. Thus the cap layer thickness only needs to be 50 to 100 Å. In the cases of the non Al-containing window layers, the primary function of the cap layer is for providing an adequate value of sheet conductance.

The cap layer is important for ensuring that the window layers containing aluminum are of high quality. If a window layer containing aluminum is oxidized, this may cause creation of interface states at the emitter-window interface, which will affect the dark current of the betavoltaic device and its charge collection efficiency. Another important effect of the cap layer is to provide for a higher yield in cell growth due to the oxidation protection provided by the cap layer. Higher yield translates into lower production costs.

The cap layer is critical for betavoltaic devices. In the case of solar cells, a thin cap layer absorbs solar photons, and therefore is not utilized in such devices. Solar cells are designed with a relatively thick emitter to provide good sheet conductance and thus do not require a cap layer for sheet conductance. The emitter in the typical III-V solar cell contributes to the collection efficiency. Since Tritium betas are absorbed in such a short distance, the PIN device is designed with a very thin emitter such that Tritium betas are primarily absorbed in the intrinsic region.

In another embodiment of the present invention a new device structure is presented for efficient direct conversion of Tritium. The betavoltaic device comprises an innovative three layer device structure comprising a Metal/Inter-Layer/Semiconductor (MILS). The inter-layer can be an insulator or a semiconductor with a band gap larger than the band gap of the base semiconductor material. A lattice-matched wide band gap semiconductor is the preferred choice for an Inter-Layer. However, very good results have been achieved with Inter-Layers that are insulators. By insulator, we refer to a material that has a very large band gap and cannot be doped. The total thickness of the metal and Inter-Layer is typically a few hundred Angstroms. Thus, only a small percentage of the incident Tritium beta flux is absorbed in the metal and Inter-Layer. The semiconductor layer is the primary absorber of the betas and is the region where the electron-hole pairs are produced. MILS structures have three desirable features:

(a) Large values of short circuit current;

(b) Low dark current due to the effect of the inter-layer;

(c) Reduced fabrication cost compared to homojunctions due to a simplified device structure.

Table 2 lists some examples of efficient MILS devices under Tritium beta flux.

TABLE 2

| Examples of MILS structures | | |
|---|---|---|
| Metal | Inter-Layer | Semiconductor Absorber |
| Al for p-InGaP, Au for n-InGaP | InAlP (Lattice Matched) | InGaP |
| Al for p-GaAs, Au for n-GaAs | AlGaAs (Lattice Matched) | GaAs |
| Al for p-GaAs, Au for n-GaAs | InGaP (Lattice Matched) | GaAs |
| Al for p-Si, Au for n-Si | $SiO_2$ | Silicon |
| Al for p-Si, Au for n-Si | ZnS (Lattice Matched) | Silicon |
| Al for p-Si, Au for n-Si | GaP (Lattice Matched) | Silicon |

The choice of metal depends on the whether the semiconductor absorber is n-type or p-type and on the absorber material electron affinity. Usually the metal films will be Al for p-type semiconductors and Au or Pt for n-type material.

Figure 4:
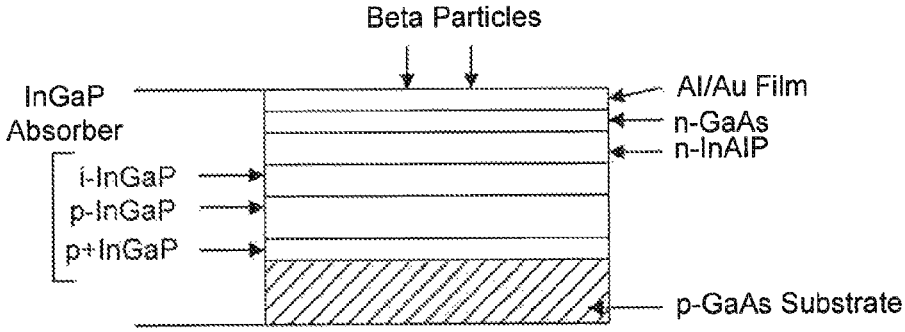
FIG. 4 illustrates a physical structure of an InGaP MILS device.
Figure 5:
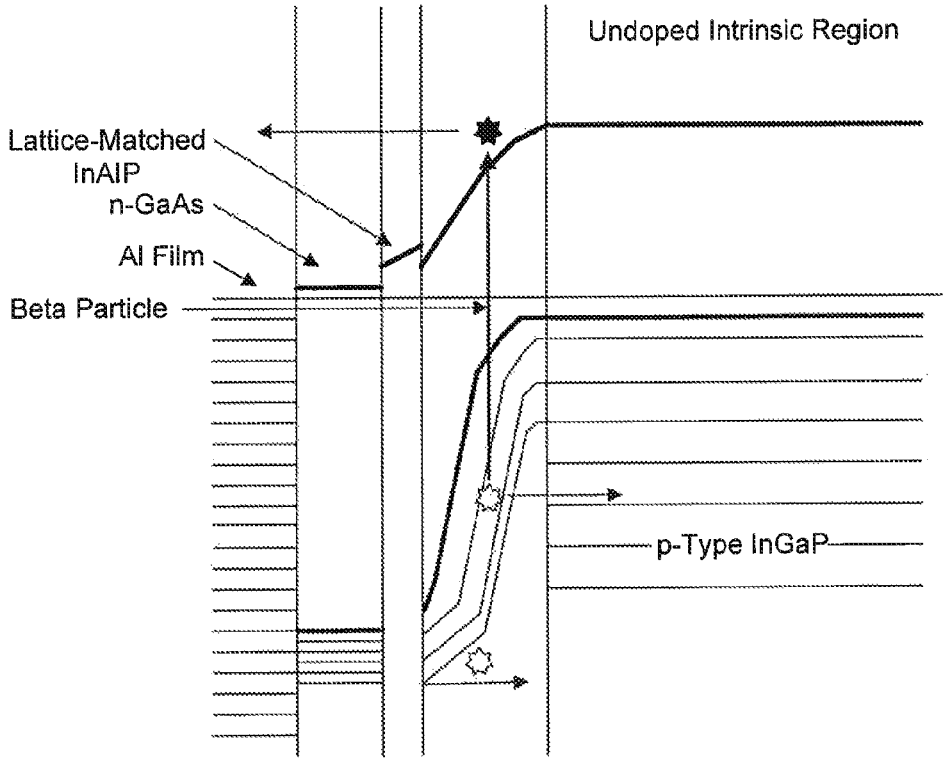
FIG. 5 is an electron band diagram for an InGaP MILS device.

In one embodiment, the general physical structure of an MILS device based on InGaP is illustrated in FIG. 4 with the corresponding electron band structure given in FIG. 5. The metal responsible for formation of the built-in voltage is Aluminum. The work functions for Aluminum and p-type InGaP are approximately 4.1 eV and 5.8 eV, resulting in a barrier of approximately 1.7 eV, which is similar to that expected for an InGaP homojunction. Therefore, it is possible to achieve the same dark current with the InGaP MILS device. An exemplary film of Gold is shown on top of the Aluminum. This film protects the Aluminum from oxidation, and does not affect the junction characteristics. The Inter-Layer for this structure is a thin film of lattice-matched n-type InAlP. This layer reflects holes but allows electrons to pass. The absorber semiconductor region includes a layer of intrinsic InGaP (no dopants) to act as a buffer to zinc diffusion from the p-type InGaP region. FIG. 5 describes the electron band diagram and indication of electron and hole transport upon absorption of betas.

Figure 6:
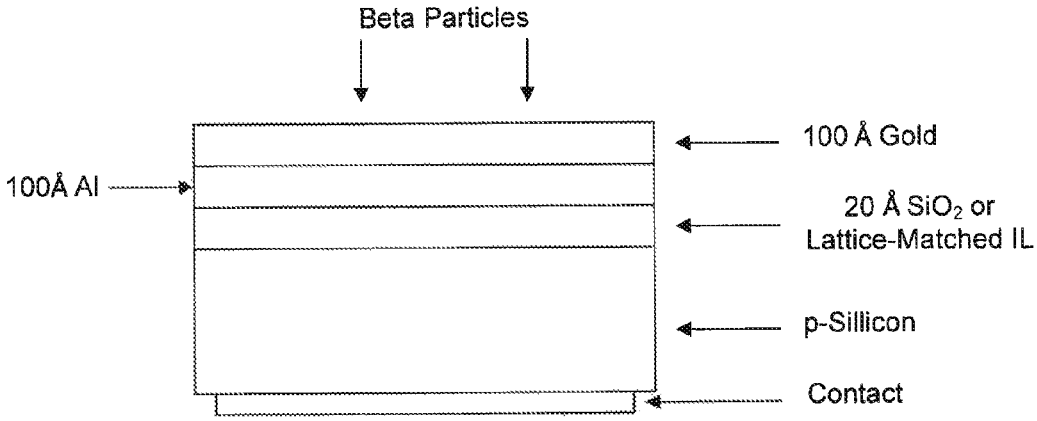
FIG. 6 illustrates a physical structure of an Al/SiO2/p-Si device.
Figure 8:
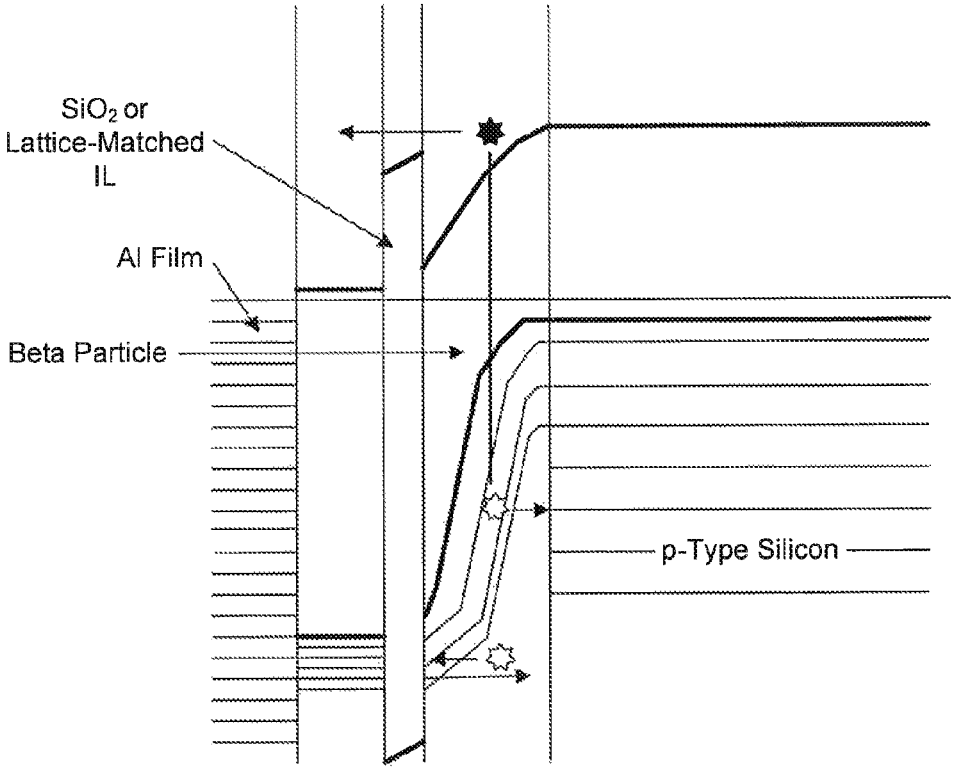
FIG. 8 illustrates a band diagram for an Al/SiO2/p-Si MILS device.

In another embodiment a Silicon MILS device provides an increase in efficiency over prior art Silicon based homojunction cells due to the MILS construction providing a decrease in dark current and increasing short circuit current. The Tritium based Silicon MILS device efficiency can be approximately 2-3%. FIGS. 6 and 8 illustrate the physical structure and corresponding electron band diagram for an Al/$SiO_2$/p-Si. betavoltaic device. $SiO_2$ is an insulator that cannot be made conductive. As noted in Table 2, ZnS and GaP are examples of large band gap semiconductor Inter-Layers. These materials are particularly interesting because they lattice-match silicon. In general, there can be interface states at an Inter-Layer and silicon boundary. The density of these states are relatively low for a $SiO_2$/Si interface, and could be low for the lattice matched interfaces. As noted, Gold and Platinum can be used for MILS cells fabricated with n-type Silicon.

Figure 7:
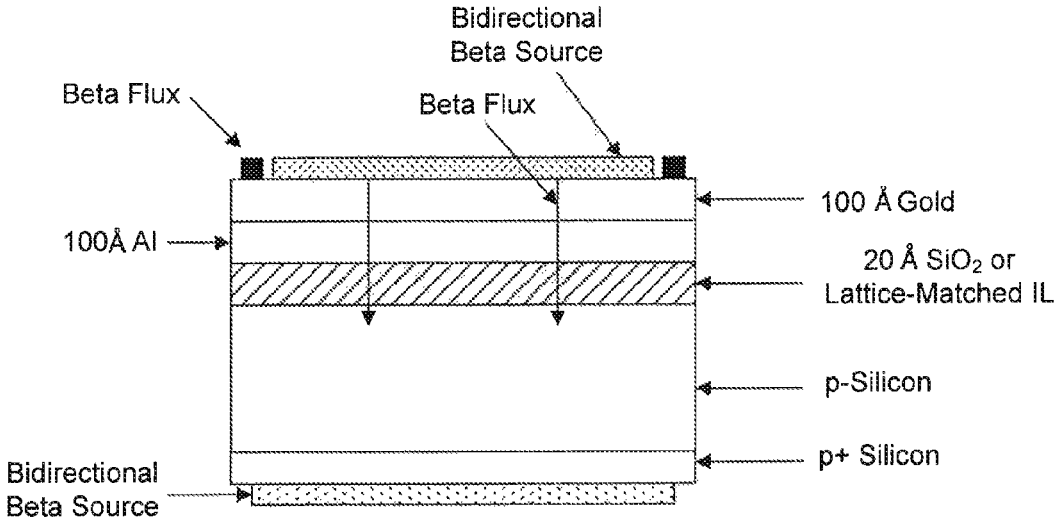
FIG. 7 illustrates a physical structure of a bidirectional Al/SiO2/p-Si MILS device.

In yet another embodiment, FIG. 7 illustrates an approach to using bidirectional sources with thin Silicon wafers. The wafers can typically be 4 mils (~100 microns) thick and have minority carrier diffusion lengths greater than about 100 microns. The Silicon wafers are polished on both sides, doped with Boron to give a resistivity on the order of 0.1 ohm-cm, and have a back-surface-field established on the back surface (BSF). The BSF would be formed by doping with a high concentration of Boron. Beta particles enter the top and bottom surfaces. The large minority carrier diffusion length allows excited carriers throughout the wafer to be collected so that the current produced is about two times that of a device coupled to a unidirectional source. In a stacking arrangement, the system efficiency approximates two-times that of a stack based on unidirectional sources, thereby achieving a high efficiency Tritium betavoltaic with a Silicon semiconductor.

In both PIN and MILS betavoltaic device structures the Tritium source is a Tritium metal hydride (sometimes referred to as a Metal Tritide), that is in contact with the top surface of the betavoltaic structure as shown in FIG. 1. The Tritium metal hydride may be formed by methods known in the art. Some examples of Tritium metal hydrides include Scandium Tritide, Titanium Tritide, etc. These Tritium metal hydrides may be formed on an independent foil or substrate that is then physically laid on top of the semiconductor containing the betavoltaic device. Alternatively, the Tritium metal hydride may be formed as a thin film (e.g. about 100 nm-500 nm) on top of the semiconductor containing the betavoltaic device using methods known in the art. For example a Scandium or Titanium film is deposited as a thin film (e.g. sputtered, evaporated, etc.) onto the semiconductor or substrate and then tritiated using methods known in the art.

In another embodiment of the present invention the contact lines on the top surface of the betavoltaic homojunction can be very thin and on the perimeter of the semiconductor. This contact ring is used to collect the charge current from the semiconductor while providing a minimal shadowing effect to the radioactive source's beta flux that impinges on the surface of the semiconductor. The contact ring for the betavoltaic semiconductor may be formed in the same manner as solar cell industry uses to make contact gridlines on the solar cell semiconductor. However, the betavoltaic cell contact ring is substantially different from a solar cell where a series of gridlines are uniformly covering the surface of the semiconductor and can cover approximately 5-10% of the semiconductor surface. This uniform coverage creates a shadowing effect resulting in a proportional loss of power from the solar cell. In contrast the betavoltaic cell's contact ring may be reduced to a small perimeter (e.g. outlining a 1 cm×1 cm cell or 3 cm×3 cm cell etc.) or it may be just a set of contact points or lines. This is due to the low current collection from the betavoltaic device that is in the nanoamp to microamp per square centimeter range as opposed to solar cells where the range is more in the milliamp per square centimeter range, thus requiring less series resistance by the inclusion of more contact line coverage.

As an example, the contacts in a betavoltaic semiconductor can result in a shadow coverage that is much less than about 1%, thereby providing a higher efficiency betavoltaic battery. Specific shadow coverage and thicknesses of contact ring, lines or dots required by a betavoltaic semiconductor is dictated by a consideration of diffusion length of the carriers to the contact points/lines and the series resistance that may be tolerated by the incident beta flux density and betavoltaic semiconductor's efficiency.

In all embodiments of the present invention the edges of the betavoltaic structure are shielded from beta particles. This constitutes another novel aspect of the present invention. As is known in the art, if the energy of a beta particle is large enough, the particle can cause the displacement of an atom in a crystalline semiconductor. Atomic vacancies can act as a recombination center for EHP's in semiconductors and can cause degradation of betavoltaic efficiencies. Fortunately, the threshold for atomic displacement in semiconductors is typically greater than 250 keV. Therefore, tritium beta particles as well as beta particles from Promethium-147 and Nickel 63 do not cause degradation of semiconductor diode properties as a result of beta absorption within the bulk of the material. However, low energy betas can create dangling bonds along the junction periphery, which can cause shunting currents or carrier recombination at the junction edges. If the edges are not properly shielded or protected from the beta flux, the betavoltaic device performance/efficiency will degrade.

Figure 9:
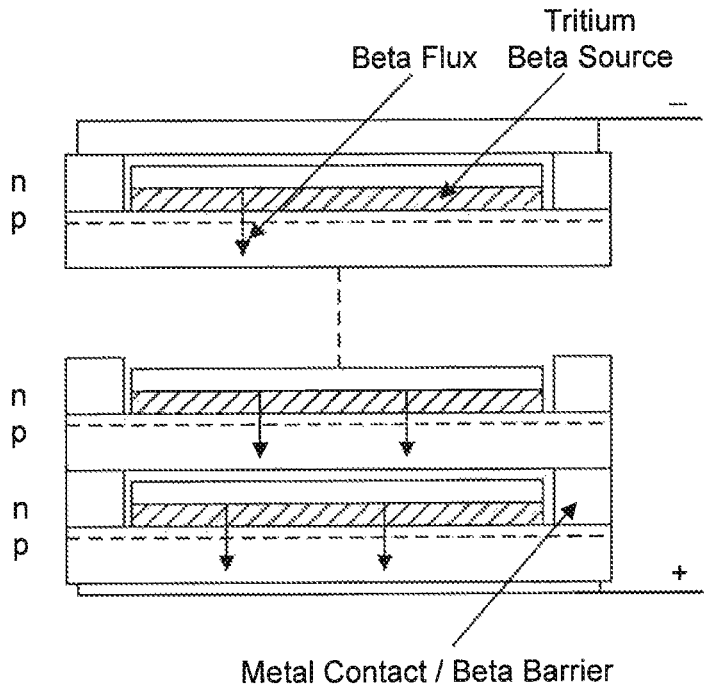
FIG. 9 illustrates one embodiment for stacking a plurality of n/p (or p/n) cells in series.

As illustrated in FIGS. 9-11, the junction edges may be protected by the keeping the Tritium source within the perimeter contact metal gridlines at a distance that the beta particle cannot reach the edges of the semiconductor. Furthermore, the metal perimeter contact gridlines act as a physical barrier to the beta flux, thus preventing the beta particles from hitting the edge of the device. It should be understood that protection of the edges may be accomplished through a variety of means such as all forms of physical barriers (e.g. deposited metal barriers, polymers, insulators etc.) or simply physical distance acting as a barrier to beta particles impinging on the betavoltaic semiconductor's edges.

In all embodiments of the present invention, the voltage and current may be scaled up via the stacking of betavoltaic semiconductors and Tritium sources (betavoltaic cells) as illustrated in the approaches to connecting betavoltaic cells in series and parallel configurations in FIGS. 9-11. Arranging multiple (N) layers of n-on-p (n/p) cells in series is illustrated in FIG. 9. If it is assumed that all cells have identical properties, namely, the same values for short circuit current (Isc), open circuit voltage (Voc) and maximum power (Pmax), and assuming the contacts betweens devices are ideal, the characteristics for the series stack are:

(Isc)stack=Isc, (Voc)stack=N×Voc, and (Pmax)stack=N×Pmax

The electrical connection between cells can be establish by a soft metal such as indium or by a deposited peripheral strip of gold or another appropriate metal. Although n/p cells are shown in FIG. 9, the same approach can be used for p/n cells. It should be noted that the n/p and p/n configurations can be utilized for PIN, NIP structures, as well as homojunctions, heterojunctions and MILS devices. In the case of an MILS cell, the second letter for the device designation in FIGS. 8, 9 and 10, can be identified as the base region of the cell. For example, an Al/SiO2/p-Si MILS cell can be considered an n/p device in the Figures.

Figure 10A:
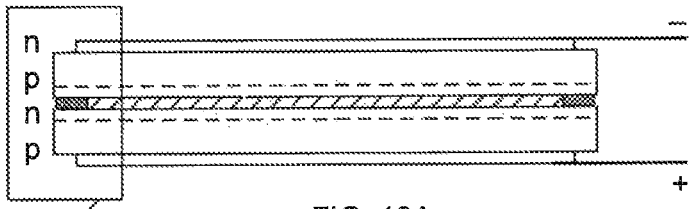
FIGS. 10A and 10B illustrate a series connection of a p/n and a n/p cell.
Figure 10B:
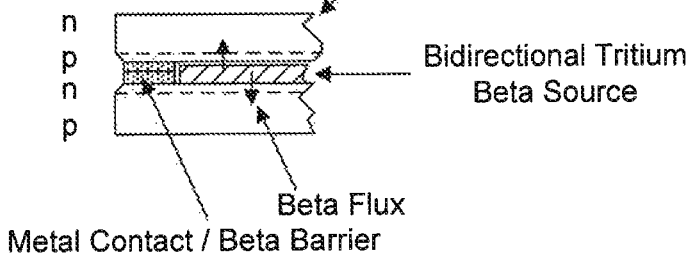

FIGS. 10A and 10B illustrate a novel approach for combining n/p and p/n cells in series with bidirectional beta sources, i.e. sources that emit beta particles in two directions as shown. This approach allows for the efficient use of a Tritium layer in a bidirectional capacity. Contacts can be formed as discussed above for the series stack. If the cells have identical properties, except for polarity, the two cell unit provides:

(Isc)unit=Isc, (Voc)unit=2×Voc and (Pmax)unit=2×Pmax

FIGS. 11A and 11B illustrate a configuration for combining two n/p (or p/n) cells in parallel and coupled to a bidirectional source. In this case, characteristics of the two cell unit are:

(Isc)unit=2×Isc, (Voc)unit=Voc and (Pmax)unit=2×Pmax

Joining methodologies of electronic component stacking (e.g., multi-chip stacking) such as, solder connections, wire bonding, and other conductive adhesive materials and techniques, can be utilized to join combinations of the configurations listed in FIGS. 9-11. This allows for a broad variety of design interconnectability, thus achieving betavoltaic batteries with a variety of current and voltage specifications.

An embodiment of the present invention involves a method of hermetically sealing a direct conversion semiconductor battery with a Tritium metal hydride source at low temperatures. During construction of the battery and sealing, there is no leakage of Tritium from the metal hydride due to high temperature sealing methods, such as glass frit seals or solder seals, and it poses no risk of Tritium exposure to the operator sealing the battery. Additionally, the hermetic battery design and the sealing method allow for high throughput manufacturing and low contamination of Tritium within the manufacturing facility.

Hermetic packaging and sealing techniques for integrated circuits are widely used in the semiconductor industry to prevent dirt, moisture, particulates and ionic impurities from entering the integrated circuit package and causing corrosion of the circuit elements and interconnects. In an embodiment of the present invention a combination of these techniques and packaging designs prevents Tritium from exiting the battery package. That is, the role of hermetic packaging and sealing for integrated circuits is reversed in the case of the Tritium battery, from contamination entering the IC package to preventing radioactive contamination from exiting the Tritium battery package.

In this embodiment of the present invention, the battery package is comprised of a ceramic or metal package housing containing electrode pins or leads from an internal area of the package to an external area of the package. These leads serve as conduits of electrical power for the battery and are connected to a load on a circuit board or other device. The leads are hermetically attached and sealed via glass frits or commonly used techniques for hermetic sealing of leads. Although the lead sealing methods involve high temperature processes above 300° C., the leads are sealed on the battery housing prior to containment of the Tritium metal hydride. Note, the package may take any form currently in use for IC packages, i.e. PIN device leads, leadless package, surface mounts, etc.

The direct conversion semiconductor is placed or bonded within the ceramic or metal package and is connected to internal areas of the leads via wire bonds or other commonly used techniques. The Tritiated metal hydride source, comprising either Scandium or Titanium or another suitable metal, is placed in contact with the direct conversion semiconductor. A combination of direct conversion semiconductors and Tritium metal hydride source layers in series or parallel may be connected within the package. Additionally, the Tritium metal hydride source layers may be deposited directly onto the direct conversion semiconductor. Also, the direct conversion semiconductors may be formed as epilayers that are approximately 5-50 microns in thickness.

In one embodiment, the present invention uses a Kovar lid or Kovar step lid that closes the Tritium battery package. If a ceramic package is used a side brazed Kovar seal ring must be attached using techniques commonly known in the art. Note, the Kovar seal ring is attached prior to inserting the Tritiated metal hydride.

The final step in the sealing the package is the sealing of the Kovar step lid to the metal package or the ceramic side brazed package with a Kovar seal ring. See FIGS. 12A (bottom view) and 12B (side view). FIG. 12A illustrates a lid step and a lid edge. The Kovar lid is sealed with a resistance or laser welder that uses localized heating well below 200° C. to hermetically weld the lid to the package. The preferred method for welding is a parallel seam welder, which is inexpensive compared to laser welding and offers a high throughput. Note, the most common method in the IC industry for hermetic sealing is the solder weld using a belt furnace. This method involves temperatures of approximately 360° C., well above the threshold for Tritium containment.

Testing of the Tritium battery package seal is achieved by enclosing the parallel seam-sealer and the unsealed Tritium battery package within a helium glove box environment. Helium is flowed across the unsealed package and the Kovar lid is then placed on the package. The sealing is performed under a helium atmosphere enclosing a helium environment within the Tritium battery package. The Tritium battery package is then placed in an ultra-sensitive helium detector with detection levels up to 10^-11 cc/second under a 1 atmosphere differential. A leak rate of 10^-8 cc/second under a 1 atmosphere differential is considered hermetic for the Tritium battery package and easily achieved using the above method.

Another approach to testing of the hermetic seal may be achieved with a helium bombing system where the Tritium battery package is enclosed in high-pressure helium environment. Depending on the size of the leaks within the Tritium battery package the helium gas will enter the package. The package is then removed from the high-pressure environment and inserted in the ultra-sensitive helium detector unit to detect leakage rates.

In another embodiment, the containment of Tritium and radiation emanating from the Tritium metal hydride is contained within individualized tritiated direct conversion semiconductor dyes or epilayer dyes. These direct conversion dyes and Tritium metal hydrides can be supplied with appropriate encapsulation that serves to contain radiation. Encapsulation in the form of discrete, conformal coatings that can be applied through numerous techniques, such as dipping/immersion process, chemical/physical vapor deposition techniques, (e.g. potting, sputtering, evaporation, etc.). These coatings are applied as thin films and can be metallic or vitreous in nature, providing some modest structural support and robustness to the direct conversion dyes, while still providing an important, necessary, and effective barrier to the emission of beta particles arising from tritium decay and containment of the Tritium radioisotope. Encapsulation is conducted to safeguard against any radiation leakage, but would be accomplished in a conformal manner so as to leave contact leads exposed as necessary for integration into device housings and maintain geometric requirements for the dyes. These dies thusly encapsulated are then facile candidates for regulatory general and/or exempt licensure; in this manner, the encapsulated materials could easily be transported or handled without any risk of radiation exposure and without any need for specialized radiation materials training. For example, the encapsulated Tritium betavoltaic dyes could be shipped to an OEM integrator for inclusion in an integrated circuit package without a hermetic seal.

One aspect of the present invention involves increasing the surface area per unit volume in a direct conversion device without increasing the dark current, via a texturing method. Instead of texturing a surface of the betavoltaic semiconductor, an epitaxial liftoff (ELO) process is employed to remove an intact epilayer containing the betavoltaic semiconductor device. The ELO process used may be any of the techniques known to those skilled in the art. This epilayer can be made substantially free of surface defects that may harm the betavoltaic device and thus increase dark current of the device. The epilayer is approximately 0.1 microns to 5.0 microns thick and is usually coupled to a backing layer that may comprise a metallic layer (e.g. gold, copper, aluminum, titanium, scandium, platinum, silver, tungsten, and other alloys) or a polymer material (e.g. polyimide, Kapton, etc.). The composite epilayer, comprising the epilayer and backing layer, is approximately 5-50 microns thick and is flexible.

Furthermore, the composite epilayer and Tritium metal hydride comprises a thin betavoltaic device that may be stacked in series or parallel. The resulting power density for a single composite epilayer and Tritium metal hydride can be as thin as 10 microns thick and an approximate power range of 0.1 to 0.2 microwatts. Furthermore, via stacking of these individual layers the power density can reach as high as 100-200 microwatts/cm^3, thereby achieving an increase in surface area per unit volume resulting in a significant increase in power per unit volume.

In one embodiment the Tritium metal hydride film may be deposited directly onto the composite epilayer semiconductor surface to reduce the thickness of an individual composite epilayer and Tritium metal hydride. In another embodiment, the Tritium metal hydride may be formed on a separate thin substrate or thin foil (e.g. less than 100 microns thick) and is physically attached to the composite epilayer containing the betavoltaic device.

In one embodiment, the composite epilayer is comprised of a III-V semiconductor with a betavoltaic semiconductor device structure. The betavoltaic structure may have any of the constructions or combinations described herein. For example, the composite epilayer may have a PIN or NIP structure with or without a highly doped base, a Cap layer to protect the device from oxidation and/or an MILS structure. The composite epilayer with a betavoltaic device in its structure may be selectively etched/released from the III-V substrate via an intermediary sacrificial layer (e.g. AlGaAs) as is known in the art. The sacrificial layer can have a thickness ranging from about 1 nm to about 200 nm. Once the sacrificial layer has been removed via etching, the epilayer and backing layer together are released. In doing this, the betavoltaic device thickness is reduced from standard semiconductor wafer thickness to less than 50 micron thickness. Furthermore, a cost reduction occurs due to the fact that the substrate may be reused to grow another epilayer, thereby reducing the cost of the base substrate material of the semiconductor device.

It should be understood that any III-V direct conversion device may be formed into an epilayer through this liftoff process by utilizing a selective etch process to release the epilayer.

The various embodiments of the present invention allow construction of a single flexible epilayer Tritium betavoltaic battery. For example a thin epilayer Tritium betavoltaic battery may be constructed with either the Tritium metal hydride film connected to the epilayer or directly deposited on the epilayer. This battery may be connected to a lithium ion thin film battery available from companies such as Front Edge Technologies of Baldwin Park, Calif. These two batteries may be connected together as a joint film that may be pasted within an integrated circuit package to run the device periodically via power bursts from the lithium thin film battery. The Tritium epilayer battery can trickle charge the lithium ion film battery. Periodically the film battery can discharge power bursts at milliwatt power levels and then be recharged via the trickle charging by the Tritium Epilayer Battery.

The Tritium epilayer battery, due to its thinness and flexibility, may be inserted into the conformal coating of an integrated circuit and power the integrated circuit stealthily. It can also be combined with a lithium ion thin film battery into the conformal coating of an integrated circuit as a source of power for the integrated circuit. The Tritium epilayer battery can also be placed within an integrated circuit's package.

Another approach of the present invention involves texturing the Tritium metal hydride substrate to increase the surface area of the deposited Tritium. Using this method, the substrate is textured to produce surface roughness and then a suitable metal (e.g. palladium, titanium, scandium) for Tritium capture is deposited on the surface. Texturing the Tritium metal hydride substrate rather than the semiconductor in the betavoltaic device may avoid creating defects on the semiconductor's surface that result in a high dark current and poor efficiency.

The textured Tritium metal hydride source is then placed in direct contact with the smooth semiconductor device's surface resulting in a higher density of Tritium beta flux entering the semiconductor device. Note the Tritium may be deposited on the textured substrate via any means known in the art. Some examples include aerogels and polymers that may be deposited directly onto the textured substrate surface.

In one embodiment, a silicon substrate's surface is textured using a potassium hydroxide (KOH) etchant as is known in the art for texturing silicon solar cells to prevent reflection of sunlight. In this embodiment, square based pyramids with approximately 10 micron tall peaks, as measured from the base, are formed on the surface. The resulting surface area is 1.8 times the original planar surface. As mentioned elsewhere herein, a suitable metal is then deposited on the surface with a thickness of approximately 0.1 to 1 micron and then treated with Tritium. The metal to be tritiated is then deposited using methods known in the art. This results in a Tritium metal hydride with increased surface area on a stainless steel surface.

In another embodiment, a metal substrate (e.g. stainless steel or Titanium) surface is mechanically roughened. Conversely, periodic triangular rows are grated through the surface via a laser or other suitable method that can increase the surface area. Note, if triangular rows are formed where the triangles are equilateral in nature, the surface can reach twice the surface area of the original planar surface. A Tritiated metal hydride is then formed on the substrate.

Some of the most secure processors and field programmable gate arrays (FPGA's) are using SRAM memory to store encryption keys. However current battery technologies depend on chemistries that are unreliable over long periods of time (i.e. several years) especially under wide temperature ranges, such as −55° C. to +125° C.

The Tritium betavoltaic batteries of the present invention are able to power the SRAM memory for periods of 15-20 years or more through these extreme temperatures. Note, the voltage of Tritium betavoltaic batteries based on III-V compounds will fluctuate less in higher temperatures than silicon-based MILS devices. However, silicon-based MILS devices require higher power levels than Tritium InGaP Homojunctions to compensate for higher temperatures.

The Tritium based betavoltaic batteries of this invention allow soldier-to-base wireless communications and computer-to-base communication to be encrypted using FPGA's with encryption keys stored in SRAM as well as defense and telecom applications that experience a wide range of temperatures. Note, the Tritium betavoltaic batteries are hermetically sealed batteries packaged in surface mount packages that may be soldered to circuit board with the FPGA's Another application of Tritium based betavoltaic batteries of the present invention is for supplying power to anti-tamper volume protection for electronics and other devices that require protection from intruders. These type of batteries provide the critical longevity of more than 10 years for anti-tamper protection. Note, the temperature resilience of these batteries is critical to the longevity and reliability. In one embodiment a volume protection membrane from W. L. Gore is used on a circuit card to protect encryption keys stored in SRAM from a reverse engineering attack. The Tritium betavoltaic batteries of this present invention may be hermetically sealed in a surface mount package and soldered on the circuit board to provide power to both the volume protection device, the anti-tamper trigger in the processor and the encryption keys held in SRAM. If an attack occurs on the volume protection device (i.e., W. L. Gore volume protection membrane), the Tritium betavoltaic battery power allows the volume protection device to detect the attack and the anti-tamper trigger will erase all critical information residing in the electronics, including the encryption keys.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A device for producing electricity, comprising:
- a substrate;
- a plurality of stacked material layers above the substrate, the plurality of stacked material layers comprising,
  - a base layer doped with dopants of a first dopant type;
  - an emitter layer doped with dopants of a second dopant type;
  - a window layer having a lattice structure matched to the lattice structure of the emitter layer;
  - wherein each one of the plurality of layers comprises a type III-V semiconductor;
- a beta particle source for generating beta particles; and
- wherein the substrate comprises a GaAs substrate, the base layer comprises an n type InGaP layer, the emitter layer comprises a p type InGaP layer, and the window layer comprises a p type InAlP layer.

2. The device of claim 1 further comprising an InGaP back surface reflector layer between the substrate and the base layer.

3. The device of claim 1 wherein the plurality of stacked material layers further comprises a GaAs cap layer disposed between the window layer and the beta particle source, wherein a doping level of the cap layer is about 10^18 ND/cm^3.

4. The device of claim 1 further comprising an intrinsic InGaP layer between the base layer and the emitter layer, wherein a thickness of the intrinsic InGaP layer is between about 1000 and 3000 Angstroms or is between about 50 and 100 Angstroms.

5. The device of claim 1 wherein a bandgap of the window layer is greater than the bandgap of the emitter layer.

6. A device for producing electricity, comprising:
- a substrate;
- a plurality of stacked material layers above the substrate, the plurality of stacked material layers comprising,
  - a base layer doped with dopants of a first dopant type;
  - an emitter layer doped with dopants of a second dopant type;
  - a window layer having a lattice structure matched to the lattice structure of the emitter layer;
  - wherein each one of the plurality of layers comprises a type III-V semiconductor;
- a beta particle source for generating beta particles; and
- wherein the substrate comprises a GaAs substrate, the base layer comprises a p type InGaP layer, the emitter layer comprises an n type InGaP layer, and the window layer comprises an n type InAlP layer.

7. The device of claim 6 further comprising an InGaP back surface reflector layer between the substrate and the base layer.

8. The device of claim 6 wherein the plurality of stacked material layers further comprises a GaAs cap layer disposed between the window layer and the beta particle source, wherein a doping level of the cap layer is about 10^18 ND/cm^3.

9. The device of claim 6 further comprising an intrinsic InGaP layer between the base layer and the emitter layer, wherein a thickness of the intrinsic InGaP layer is between about 1000 and 3000 Angstroms or is between about 50 and 100 Angstroms.

10. The device of claim 6 wherein a bandgap of the window layer is greater than the bandgap of the emitter layer.

11. A multilayer device for producing electricity, comprising:

a beta particle source layer for generating beta particles; and at least three semiconductor layers each having a bandgap substantially similar to a band gap of the other layers, the at least three layers comprising a doped emitter top layer, an undoped intermediate layer and a doped bottom base layer, wherein the emitter and the base layers are doped with opposite-type dopants, and wherein the emitter layer is closer to the beta particle source layer than the base layer; wherein the emitter and the intermediate layers absorb more beta particles than the base layer.

12. The device of claim 11 further comprising a window layer in contact with the emitter layer and a cap layer atop the window layer, wherein the window layer is doped with dopants of the same dopant type as the emitter layer, the window layer having a bandgap larger than the bandgap of the emitter, intermediate and base layers, the window layer having a closely matched lattice to the emitter layer, the cap layer for current collection and for protecting the device from environmental effects.

* * * * *